US007329220B2

(12) United States Patent
Bayer et al.

(10) Patent No.: US 7,329,220 B2
(45) Date of Patent: Feb. 12, 2008

(54) SHEET PUNCHING AND EMBOSSING MACHINE

(75) Inventors: Günther Bayer, Nettetal (DE); Rudolf Erich, Wegberg (DE); Norbert Quenzel, Schwalmtal (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 381 days.

(21) Appl. No.: 10/701,740

(22) Filed: Nov. 5, 2003

(65) Prior Publication Data

US 2004/0123748 A1 Jul. 1, 2004

(30) Foreign Application Priority Data

Nov. 5, 2002 (DE) ..... 102 51 780

(51) Int. Cl.
*B31B 49/00* (2006.01)

(52) U.S. Cl. ..... 493/373; 493/143; 493/287; 493/340

(58) Field of Classification Search ..... 493/340, 493/143, 144, 287, 354, 361, 366, 373
See application file for complete search history.

(56) References Cited

U.S. PATENT DOCUMENTS 1,911,742 A * 5/1933 Berry ..... 408/98
4,171,081 A * 10/1979 Vossen et al. ..... 225/97
4,452,595 A * 6/1984 Huff ..... 493/83
4,858,898 A * 8/1989 Niikura et al. ..... 267/218
4,880,147 A * 11/1989 Tolan ..... 222/195
4,997,009 A * 3/1991 Niikura et al. ..... 138/30
5,176,613 A * 1/1993 Cavlin et al. ..... 493/354
5,529,565 A * 6/1996 Oetlinger ..... 493/468
5,655,569 A * 8/1997 Tackett ..... 138/30
5,766,123 A * 6/1998 Oetlinger ..... 493/468
5,810,233 A * 9/1998 Varidel ..... 225/97
6,012,491 A 1/2000 Mohr et al.
6,217,497 B1 * 4/2001 Laudenberg ..... 493/11
6,260,394 B1 * 7/2001 Haraga et al. ..... 72/57

FOREIGN PATENT DOCUMENTS

DE 37 02 865 A1 8/1988
DE 195 16 073 A1 11/1996

* cited by examiner

*Primary Examiner*—Sameh H. Tawfik
(74) *Attorney, Agent, or Firm*—Laurence A. Greenberg; Werner H. Stemer; Ralph E. Locher

(57) ABSTRACT

A sheet punching and embossing machine includes a device for punching blanks from sheets. The device has a frame and a bearing plate is mountable in the frame. The bearing plate is equipped with punching and grooving knives. Hydraulically activated clamping elements are provided for clamping the bearing plate in the frame. A hydraulic system includes a piston braced by a mechanical spring for building up hydraulic pressure for activating the clamping elements.

6 Claims, 3 Drawing Sheets

SHEET PUNCHING AND EMBOSSING MACHINE

BACKGROUND OF THE INVENTION

FIELD OF THE INVENTION

The invention relates to a sheet punching or cutting and embossing machine including a device for stamping or punching blanks from sheets, and a frame for accommodating a bearing plate equipped with cutting and creasing knives. The bearing plate is held in the frame by hydraulic clamping elements.

Such a device for a sheet punching or cutting and embossing machine has become known heretofore from German Published, Non-prosecuted Patent Application DE 195 16 073 A1. In the frame of the device described therein, the bearing plate is clamped in and roughly aligned by justifying and retaining screws. Fine adjustment is then accomplished by setting or adjusting stops in the frame of the bearing plate. In order to perform clamping, aligning and subsequent fine adjusting, an operator must manually tighten the justifying and retaining screws and likewise manually adjust the take-up frame until the bearing plate is precisely aligned in the device.

The integration of hydraulic clamping elements into the frame of the bearing plate, which is described in the 2001 annual corporate report of the firm Jagenberg in Neuss, Germany is a conventional procedure for reducing set-up times. That report describes a take-up frame, also known as a chase, wherein the stamping or punching die is fixed in the frame by hydraulic cylinders as opposed to conventional clamping by screws.

SUMMARY OF THE INVENTION

It is accordingly an object of the invention to provide a sheet punching and embossing machine with a device for punching blanks from sheets for a sheet punching and embossing station, which overcomes the hereinafore-mentioned disadvantages of the heretofore-known devices of this general type and which, with minimal structural devices, makes possible a reduction of set-up times for maximum repeatable accuracy, while being simultaneously capable of compensating for pressure fluctuations in the hydraulic system.

With the foregoing and other objects in view there is provided, in accordance with the invention, a sheet punching and embossing machine, comprising a device for punching blanks from sheets. The device has a frame and a bearing plate is mountable in the frame. The bearing plate is equipped with punching and grooving knives. Hydraulically activated clamping elements are provided for clamping the bearing plate in the frame. A hydraulic system including a piston braced by a mechanical spring is provided for building up hydraulic pressure for activating the clamping elements.

In accordance with another feature of the invention, the sheet punching and embossing machine further includes at least another hydraulic system. At least two of the hydraulic systems are independently operable for clamping-in the bearing plate.

In accordance with a further feature of the invention, a first one of the hydraulic systems serves for positioning the bearing plate in the frame in a direction of travel. A second one of the hydraulic systems serves for positioning the bearing plate in the frame transversely to the direction of travel.

In accordance with an added feature of the invention, at least two of the clamping elements respectively serve for positioning and fixing the bearing plate on both sides transversely to a direction of travel. At least one of the clamping elements serves for positioning and fixing the bearing plate on one side in the direction of travel.

In accordance with a concomitant feature of the invention, the hydraulic systems are integrated into the frame.

Thus, the object of the invention is attained by providing a piston braced or supported by a mechanical spring for building up the pressure in the hydraulic system. The hydraulic clamping of the bearing plate, in accordance with the invention, eliminates a need for a mechanical clamping by justifying and retaining screws. The bearing plate merely has to be inserted by the operator in order to be positioned and fixed in the frame. During the insertion of the bearing plate into the frame, the positioning occurs by a cylinder pin that is fastened to the frame. Thereafter, the bearing plate is fixed by a successive pressure build-up in the hydraulic system. Since only the application of pressure to the hydraulic system must be performed by the operator, manual aligning in the frame is completely eliminated, and consequently the set-up time is appreciably reduced.

Integrating a spring or spring package, for example, in the form of successively disposed disk springs, into the cylinder of the hydraulic system, with the spring being connected with the piston, creates the possibility of counteracting a pressure drop, for example, in the event of a leak. A bias tension or prestressing is applied to the spring during the build-up of pressure in the hydraulic system, so that the spring is able to compensate for a pressure drop.

Other features which are considered as characteristic for the invention are set forth in the appended claims.

Although the invention is illustrated and described herein as embodied in a sheet punching and embossing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
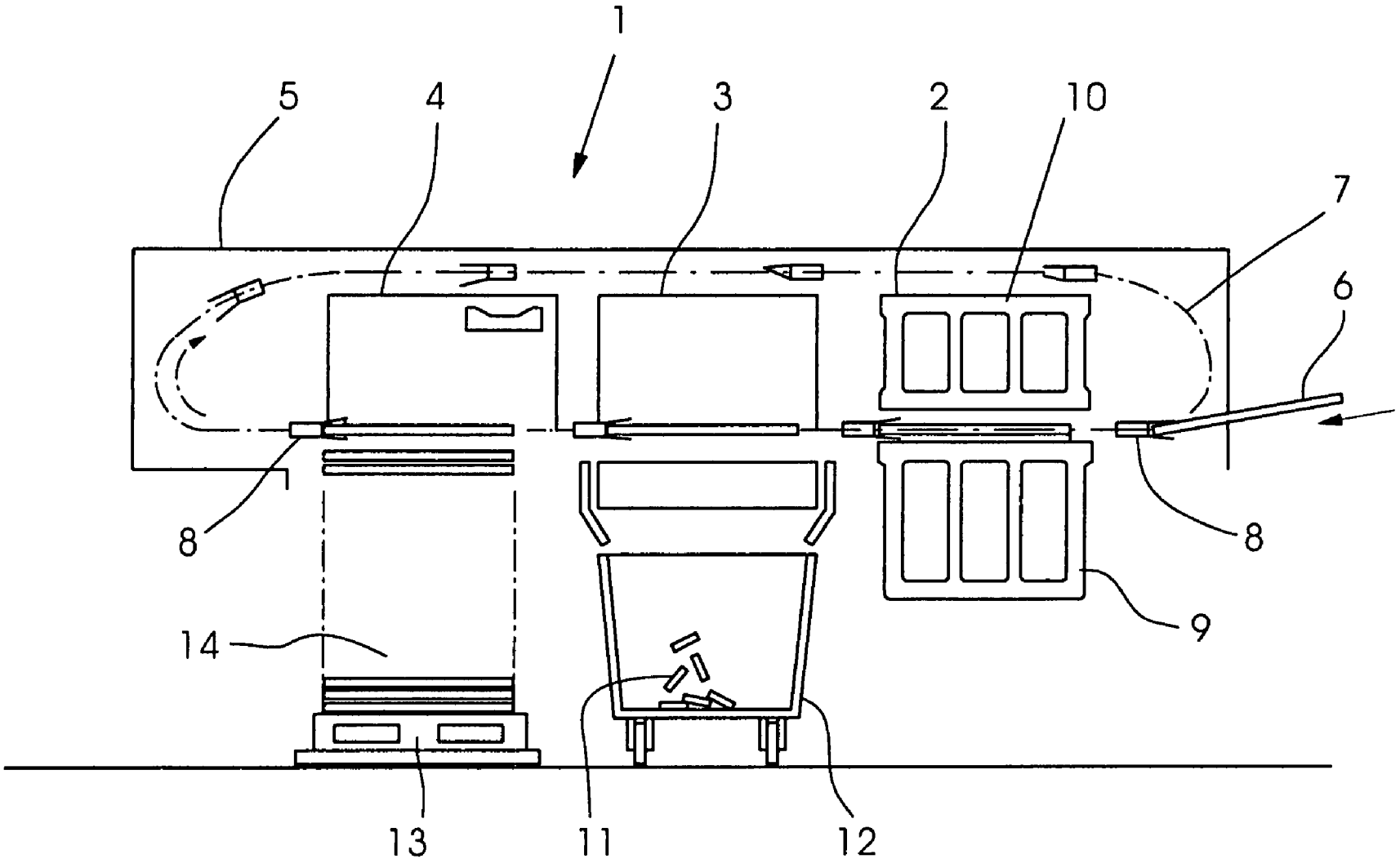
FIG. 1 is a diagrammatic, side-elevational view of a main structure of a sheet punching and embossing machine.

Referring now to the figures of the drawings in detail and first, particularly, to FIG. 1 thereof, there is seen a main structure of a sheet punching and embossing machine 1 for punching or cutting, stripping, and distributing sheets of paper, board such as cardboard or pasteboard, and the like.

The punching and embossing machine 1 is made up of stations, namely a punching or cutting device 2, a stripping device 3 and a distributing device 4, which are carried by and encased in a common machine housing 5.

Sheets 6 are grasped at respective front or leading edges thereof by gripper bars 8 which are fastened on revolving chains 7 and are intermittently pulled through the various stations 2, 3 and 4 of the punching and embossing machine 1.

Figure 2:
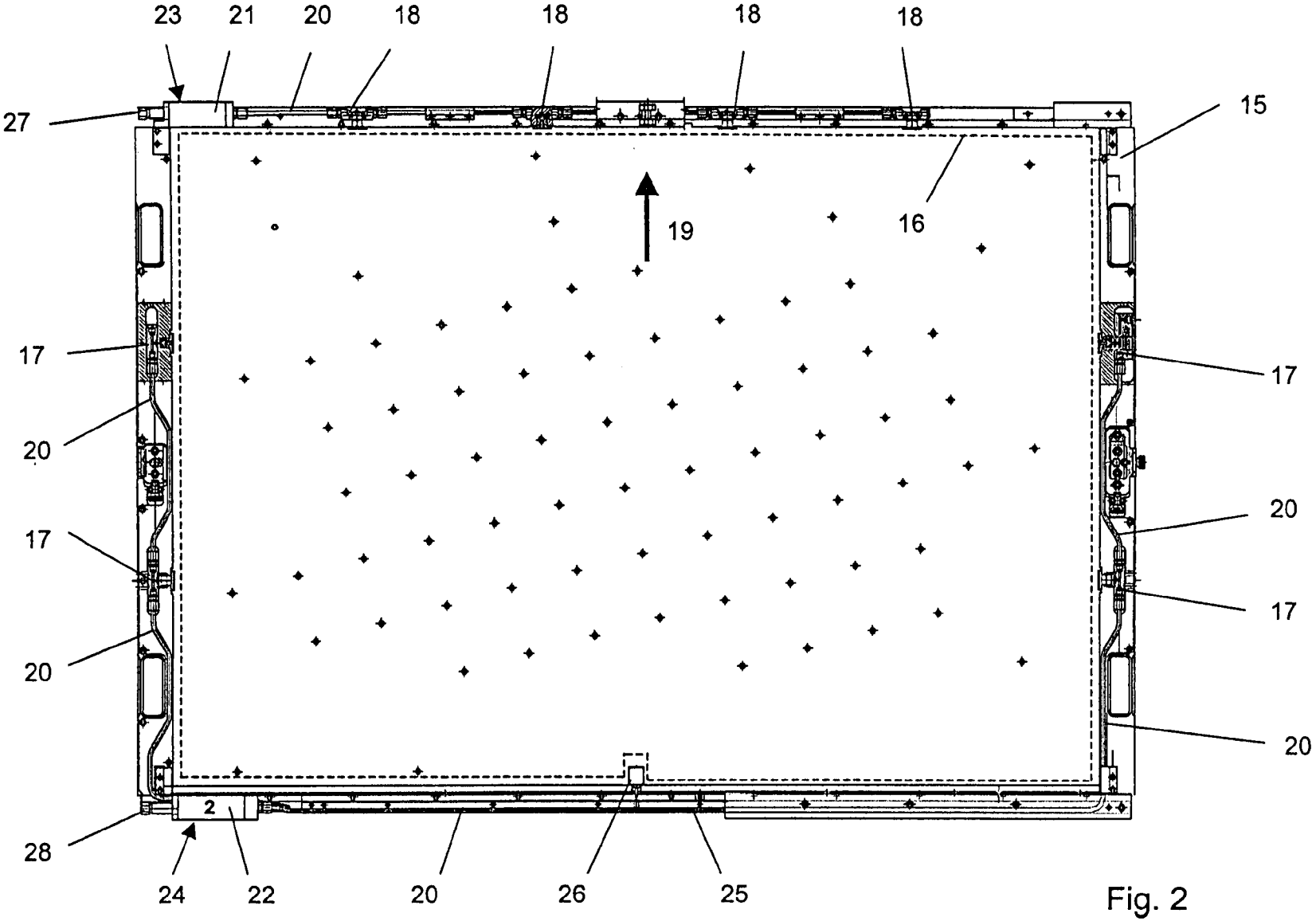
FIG. 2 is a plan view of a frame for accommodating a bearing plate.

The punching or cutting device or station 2 contains a device made up of a lower table 9 and an upper table 10. The lower table 9 is fixed in the frame of the machine 1 and provided with a counterplate for a punching or cutting knife. The upper table 10 is mounted so as to be vertically movable and is drivable by a drive for the device. In this regard, as is seen in FIG. 2, the upper table 10 contains a frame 15 for receiving a bearing plate 16 that is provided with punching and grooving knives.

The gripper bar 8 transports the sheet 6 from the punching and embossing device or station 2 into the following stripping device or station 3, which can be equipped with stripping tools. In the stripping station 3, waste pieces 11 which are not needed are forced down off of the sheet by the stripping tools. These pieces 11 drop into a receptacle-type carriage 12 that is inserted beneath the station.

From the stripping device or station 3, the sheet 6 reaches the distributing device or station 4, wherein the sheet is either simply deposited, or the individual blanks are advantageously simultaneously separated. The distributing station 4 can also contain a pallet 13 whereon the individual sheets are accumulated in a stack or pile 14. The pallet 13 with the sheets stacked or piled thereon is removable from the vicinity of the punching and embossing machine 1 after the stack or pile 14 has reached a given height.

As is apparent from the figures, the chains 7 carry a number of gripper bars 8, namely eight in the example of FIG. 1, so that several sheets 6 can be processed simultaneously in the various stations 2, 3 and 4.

FIG. 2 is a plan view of the frame 15 for accepting the bearing plate 16 as part of a device which is movable out of the punching or cutting station 2. Revolving clamping elements 17 and 18 for fixing the bearing plate 16 are integrated in the frame 15. The exemplary embodiment of FIG. 2 has a frame 15 which is equipped with four clamping elements 18 on one side in a direction of travel 19 and two clamping elements 17 on either side transverse to the direction of travel 19. The clamping elements 17 and 18 are connected to respective hydraulic cylinders 22 and 21 via pressure lines 20 for supplying pressure. As shown, the clamping elements 18 are pressure-charged by the hydraulic cylinder 21, and the clamping elements 17 are pressure-charged by the hydraulic cylinder 22. Two mutually independently operating hydraulic systems 23 and 24 are thus integrated into the frame 15.

The frame 15 is provided on a long side 25 thereof, which is shown at the bottom of FIG. 2, with a cylinder pin 26 by which the bearing plate 16 is positioned during insertion. Alignment of the bearing plate 16 then occurs first by the fixing thereof by the hydraulic system 21 and then by the fixing thereof by the hydraulic system 24, as is described in greater detail below.

The bearing plate 16 is inserted into the frame 15 by the operator and roughly positioned by the cylinder pin 26 that is fastened on the long side 25 of the frame 15, which is shown at the bottom of FIG. 2. There are no hydraulic clamping elements 17 and 18 integrated into the frame 15 on this long side 25. First, the clamping elements 18 are charged with pressure by the operator. This occurs when the operator manually actuates the clamping screw 27 at the hydraulic cylinder 21, which results in a successive pressure build-up in the hydraulic system 23, causing the clamping elements 18 to fix the bearing plate 16 against the cylinder pin 26 and the long side 25 of the frame 15 at the bottom of FIG. 2. Next, the hydraulic system 24 is charged with pressure by rotation of a clamping screw 28 at the hydraulic cylinder 22. Due to the successive pressure build-up in the clamping elements 17, all of the pistons of the clamping elements 17 initially contact the bearing plate 16. As the pressure rises in the clamping elements 17, the bearing plate 16 also becomes fixed transversely to the direction of travel 19. In order to align the bearing plate 16, the operator must simply actuate the two respective clamping screws 27 and 28 of the hydraulic systems 23 and 24, so that the bearing plate 16 is clamped in the frame 15 and aligned with minimal set-up time periods.

Figure 3:
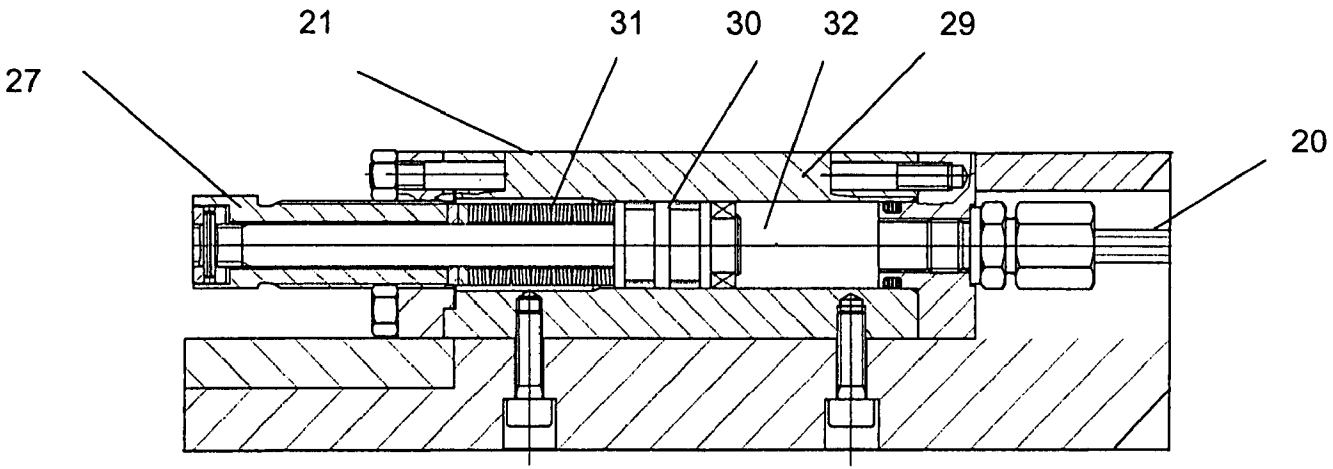
FIG. 3 is an enlarged, fragmentary, sectional view of FIG. 2, showing a hydraulic cylinder of a hydraulic system in greater detail.

The hydraulic systems 23 and 24 are formed primarily of the hydraulic cylinders 21 and 22, the pressure lines 20 and the clamping elements 17 and 18. FIG. 3 is a sectional view of a hydraulic cylinder 21. The hydraulic cylinder 21 is made up for the most part of a cylinder 29, a clamping screw 27, a guided piston 30, and a spring package 31. The pressure line 20 is connected to the hydraulic cylinder 29.

In order to pressurize the hydraulic fluid, which is particularly in the form of hydraulic oil, the piston 30 is pushed into a cylinder chamber 32 by the clamping screw 27.

Upon the attainment of a defined pressure, the piston 30 compresses the spring package 31 in the direction of the clamping screw 27, building up a bias tension or pretensioning in the hydraulic fluid. Should a pressure drop occur, for example in the event of a leak, the spring package 31 then counteracts the pressure drop. The hydraulic system 23 is thus in a position to compensate for a pressure drop. Leakage wherein very small amounts of hydraulic fluid escaped would cause a large pressure drop, because only small amounts of hydraulic fluid are present in the hydraulic system 23.

Figure 4:
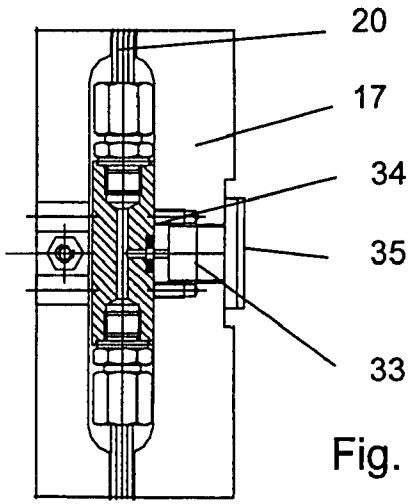
FIG. 4 is another enlarged, fragmentary, sectional view of FIG. 2, showing a clamping element in greater detail.

FIG. 4 illustrates the main construction of a clamping element 17. The pressure line 20 is screwed directly into the clamping element 17 and supplies a piston-cylinder unit 33, 34 with hydraulic fluid, the piston 33 being provided with a pressure part 35 which acts directly upon the bearing plate 16. When the clamping element 17 is charged with pressure, the piston 33 moves in the direction of the bearing plate 16 and fixes it in the frame 15, a normal operating pressure being several hundred bars in this case. The clamping elements 17 generate a force clearly over 500 N per clamping element. In the pressure-free state, the piston 33 returns to the initial setting thereof. Resetting can also occur by a non-illustrated piston reset spring.

It is also imaginable, in accordance with the invention, to provide guided wedges which can be pushed against one another as clamping elements 17 and 18. In that case, the piston-cylinder unit acts upon one wedge and pushes the other wedge in the direction of the bearing plate 16, so that the bearing plate 16 is positioned and fixed by the wedges or a piston which is disposed on the wedge. The wedges are then reset either by the depressurizing of the piston-cylinder unit or by a resetting spring.

We claim:

1. A sheet punching and embossing machine, comprising:

a device for punching blanks from sheets, said device having a frame;

a bearing plate to be mounted in said frame, said bearing plate having punching and grooving knives;

hydraulically activated clamping elements for clamping said bearing plate in said frame, and a hydraulic system including a mechanical spring disposed between a clamping screw and a piston for activating said clamping elements.

2. The sheet punching and embossing machine according to claim 1, further comprising at least another hydraulic system, at least two of said hydraulic systems being independently operatable for clamping-in said bearing plate.

3. The sheet punching and embossing machine according to claim 2, wherein a first one of said hydraulic systems serves for positioning said bearing plate in said frame in a direction of travel, and a second one of said hydraulic systems serves for positioning said bearing plate in said frame transversely to said direction of travel.

4. The sheet punching and embossing machine according to claim 2, wherein said hydraulic systems are integrated into said frame.

5. The sheet punching and embossing machine according to claim 1, wherein at least two of said clamping elements respectively serve for positioning and fixing said bearing plate on both sides transversely to a direction of travel, and at least one of said clamping elements serves for positioning and fixing said bearing plate on one side in said direction of travel.

6. A method for fixing a bearing plate in a device for punching blanks from sheets, the method comprising:

providing a device for punching blanks from the sheets, the device having a frame;

placing a bearing plate with punching and grooving knives in the frame;

activating a hydraulic system having a mechanical spring disposed between a clamping screw and a piston for clamping the bearing plate in the frame with hydraulically activated clamping elements.

* * * * *